US005478969A

United States Patent [19]

Cardey, III et al.

[11] Patent Number: 5,478,969

[45] Date of Patent: Dec. 26, 1995

[54] CONTROL SYSTEM FOR A MUSICAL INSTRUMENT

[75] Inventors: Max L. Cardey, III, Riverside; Gustavo Dimidjian, Moreno Valley, both of Calif.

[73] Assignee: Sound Ethix Corp., Riverside, Calif.

[21] Appl. No.: 376,034

[22] Filed: Jan. 20, 1995

Related U.S. Application Data

[63] Continuation-in-part of Ser. No. 85,819, Jul. 2, 1992, abandoned.

[51] Int. Cl.[6] ..... G10H 1/00; G10H 1/06

[52] U.S. Cl. ..... 84/626; 84/662; 84/701; 84/737

[58] Field of Search ..... 84/600, 626–633, 84/644, 662, 665, 670, 687, 701, 711, 718, 723, 726, 734, 737–741, 743

[56] References Cited

U.S. PATENT DOCUMENTS

| | | | |
|---|---|---|---|
| RE 31,019 | 8/1982 | Evangelista . | |
| 3,443,018 | 5/1969 | Krebs . | |
| 3,555,166 | 1/1971 | Gasser . | |
| 4,281,573 | 8/1981 | Yarema . | |
| 4,336,734 | 6/1982 | Polson . | |
| 4,570,521 | 2/1986 | Fox . | |
| 4,580,479 | 4/1986 | Bonanno . | |
| 4,699,038 | 10/1987 | Wedge | 84/1.1 |
| 4,817,486 | 4/1989 | Saunders . | |
| 4,867,028 | 9/1989 | Jones . | |
| 4,905,560 | 3/1990 | Suzuki et al. . | |
| 4,998,457 | 3/1991 | Suzuki et al. . | |
| 5,007,324 | 4/1991 | DeMichele . | |
| 5,245,128 | 9/1993 | Traiza | 84/626 |
| 5,300,730 | 4/1994 | Ekhaus . | |
| 5,403,970 | 4/1995 | Aoki | 84/626 |

OTHER PUBLICATIONS

Product Literature for Vibrato Bridge: WVB VS80/VS90.
Product Literature for Roland GR–1 Guitar Synthesizer.
Product Literature for Alesis OEM Reverb Module SP–16.

*Primary Examiner*—Vit W. Miska
*Attorney, Agent, or Firm*—Knobbe, Martens, Olson & Bear

[57] ABSTRACT

A control system for a musical instrument, e.g., an electric guitar, which is programmable so that a tremolo characteristic can be applied to the audio signal produced by the musical instrument. The tremolo characteristic can be comprised of a combination of three preset amplitude components and three preset frequency components. The control system can also be used to dynamically vary the volume characteristic of the audio signal produced by the musical instrument. Specifically, the control system includes a tactile member which produces a signal proportionate to the pressure exerted on the tactile member by the musician. This signal can be used to increase the volume characteristic of the musical instrument while the musician is playing the musical instrument.

12 Claims, 13 Drawing Sheets

CONTROL SYSTEM FOR A MUSICAL INSTRUMENT

RELATED APPLICATIONS

This application is a continuation-in-part of a U.S. patent application entitled "Pressure Sensitive Audio Control Apparatus and Guitar Incorporating Same", U.S. Ser. No. 08/085,819, filed Jul. 2, 1992, now abandoned, which is hereby incorporated by reference in its entirety. This application is related to a U.S. patent application entitled "Sound Effects Control System for Musical Instruments", Serial No. unknown, filed on even date herewith (Our Ref: ROYALC.002CP1) , which is also hereby incorporated by reference in its entirety.

BACKGROUND OF THE INVENTION

1. Field of the Invention

The present invention generally relates to a system for controlling the output-of a musical instrument and, in particular, concerns a system which includes a pressure sensitive control device which is mounted on a musical instrument to allow the player of the instrument to alter various characteristics of the audio output signal of the musical instrument.

2. Description of the Related Art

Electric guitars are extremely popular musical instruments as they can produce a wide range of different sounds when they are used in conjunction with an amplifier. The musician can produce sound signals having a wide range of volume with an electric guitar and the musician can also produce a sound signal from the electric guitar that has a particular sound quality. For example, using the amplifier, the musician can produce a sound signal having a characteristic which varies in volume over time. This characteristic is generally referred to as tremolo. Other types of sound signals that can be produced using an electric guitar include reverberation, vibrato and the like.

The sound signals produced by the guitar are generally adjusted by the musician either changing the settings of dials on the guitar, or by changing settings of dials on an amplifier. Foot pedals are also often used to change the characteristics of the audio signals produced by an electric guitar. It can be appreciated, however, that these devices for changing the characteristics of the sound signals have several disadvantages for the musician.

Specifically, if the musician has to remove his hands from the strings of the guitar to adjust a dial, he cannot continue playing the instrument during that interval. This causes disruptions in the melody that the musician is playing. This problem is somewhat solved by foot pedals which are linked to the amplifier and effectuate changes in characteristics of the audio signal. However, the foot pedals are generally fixedly positioned in one place which requires that the musician also remain in the same place. In many musical performances, the musicians prefer to move around the stage, and their ability to do so is hampered when they have to remain in the proximity of the foot pedals to effectuate changes in the characteristics of the audio signals that they are producing.

One possible solution to this problem has been proposed in U.S. Pat. No. 3,443,018 to Krebs. The Krebs patent discloses an electric guitar wherein compressive rubber resistance elements are built into the neck of the guitar at specific locations. These elements can be used by the musician to change various characteristics of the sound signals, e.g., the volume, by depressing the elements while playing the guitar. However, the guitar in the Krebs patent still suffers from several difficulties.

First, Krebs discloses a guitar wherein the compressive rubber elements are embedded in the neck of the guitar. This requires that the guitar be specially made to facilitate these rubber elements or that the neck of existing guitars be drilled and hollowed to facilitate the rubber elements. Further, the rubber elements are generally small in size and made of a solid piece of rubber. While a solid piece of rubber can be depressed by an individual, the tactile feel of a solid piece of rubber is generally very poor.

In particular, a musician who is depressing one of the elements to change a characteristic of the audio signal in the Krebs guitar will generally not be able to predict ahead of time the exact change of a characteristic of the audio signal. The musician will generally have to wait until the audio signal is produced, and then exert more or less pressure on the element to adjust the signal to have the desired characteristic. Hence, the desired audio signal may not be produced at the desired time or the characteristic may initially be not what the musician intended.

A further difficultly with the Krebs device is that some desired changes in characteristics of audio signals still require the musician to remove his hands from the guitar to effectuate the desired change. For example, if the musician wishes to change the tremolo, e.g., change the frequency of the recurring audio signal having a constant volume, the musician has to remove his hand from the guitar and change a pre-set setting of a dial on the amplifier.

Generally, tremolo settings are pre-set prior to the musician beginning a performance. The musician determines ahead of time the desired frequency of repetition of the audio signal and the desired volume and then, during the performance, engages the tremolo to produce the desired characteristic. If the musician determines during the performance that the settings for a desired effect should be changed, the musician must then stop playing the guitar and change the settings to the new desired settings. It can be appreciated that this significantly limits the flexibility of the musician to change the characteristics of the audio signal while the instrument is being played.

Hence, from the foregoing it is apparent that there is a need in the prior art for a device which allows a musician to change the characteristics of a sound signal produced by a musical instrument without removing his hands from the instrument. To this end, there is a need for an apparatus which allows the musician to know, prior to the production of the resulting sound signal, the changes in a particular characteristic that are going to occur. Further, there is also a need for a system which allows the musician to program multiple different settings for multiple different changes in characteristics ahead of time and then, while playing the instrument, change between the different changes in characteristics.

SUMMARY OF THE INVENTION

The aforementioned needs are satisfied by the present invention which is comprised of a control system having a tactile member which can be positioned on an instrument in a position where the musician can access the tactile member while playing the instrument. The tactile member produces a signal which is proportionate to the pressure exerted by the musician and this signal is then sent to a controller. The controller then interprets the signal and adjusts a characteristic of the sound signal produced by the musical instrument accordingly.

Preferably, the controller has one or more inputs which allows the musician to select between separate functions wherein separate sound characteristics can be affected by manipulation of the tactile member. In the preferred embodiment, in a volume function the controller adjusts the volume characteristic of the audio signals produced by the musical instrument. In second and third functions, i.e., the tremolo functions, the controller will adjust a tremolo characteristic that is applied to the audio signal produced by the musical instrument.

In the volume function, the controller is preferably programmed so that the musician can choose between two separate volume modes: the pressure mode and the sustained mode. In the pressure mode, the volume of the audio signal produced by the musical instrument is dependent upon the amount of pressure the musician is exerting on the tactile member. In the sustained mode, the controller selects a volume value, depending upon amount of pressure exerted on the tactile member, and sustain the volume at this volume value for any future audio signal produced by the instrument until the musician selects a higher sustained volume or clears the controller. In the preferred embodiment, the musician clears the controller by depressing the tactile member a pre-selected amount to thereby send a clear signal to the controller.

In the tremolo functions, the musician can first preset up to three separate speeds or frequencies of the tremolo. The musician initially places the controller into a tremolo frequency program mode and then selects one of the presets. The musician can then program a preset tremolo frequency by playing the instrument and depressing on the tactile member which will result in the frequency of the tremolo varying proportionately to the amount of pressure exerted on the tactile member. Once the musician has attained a desired frequency, the musician then depresses one of the inputs on the controller to record the frequency in one of the presets.

When the musician is subsequently playing the instrument, the musician can activate the tremolo and have the frequency of the tremolo set at one of the presets. The musician can change between presets by simply depressing the inputs on the controller. Further, the musician can also increase the speed or frequency of the tremolo from one of the presets by depressing the tactile member which causes the tremolo to increase proportionately to the signal from the tactile member.

Further in the tremolo functions, the musician can also program three pre-set volumes for the tremolo characteristic so that when the instrument is subsequently played and the tremolo characteristic is sought, one of the preset volume levels can be selected to dictate the amplitude of the tremolo characteristic. To program the tremolo amplitude, the musician enters the program mode and then plays the instrument. The musician adjusts the volume by depressing the tactile member until a desired volume is reached. The musician then records this desired volume as one of the amplitude presets in the controller. Subsequently, when the musician is playing the instrument, the musician can select the amplitude of the tremolo from one of three pre-set amplitudes.

From the foregoing, it is apparent that the control system of the preferred embodiment enables the musician to program preset volume levels, tremolo frequency levels and tremolo amplitude levels by simply playing the instrument and exerting pressure on the tactile member. Subsequently, the musician can select between the preset levels while playing the instrument. The musician can also use the tactile member while playing the instrument to dynamically adjust the volume of the audio signal and the frequency of a tremolo effect applied to the audio signal by exerting pressure on the tactile member. Hence, the control system affords the musician greater flexibility in adjusting the characteristics of the audio signal produced by the musical instrument.

These and other objects and features of the present invention will become more fully apparent from the following description and appended claims take in conjunction with the accompanying drawings.

DESCRIPTION OF THE PREFERRED EMBODIMENTS

Figure 1:
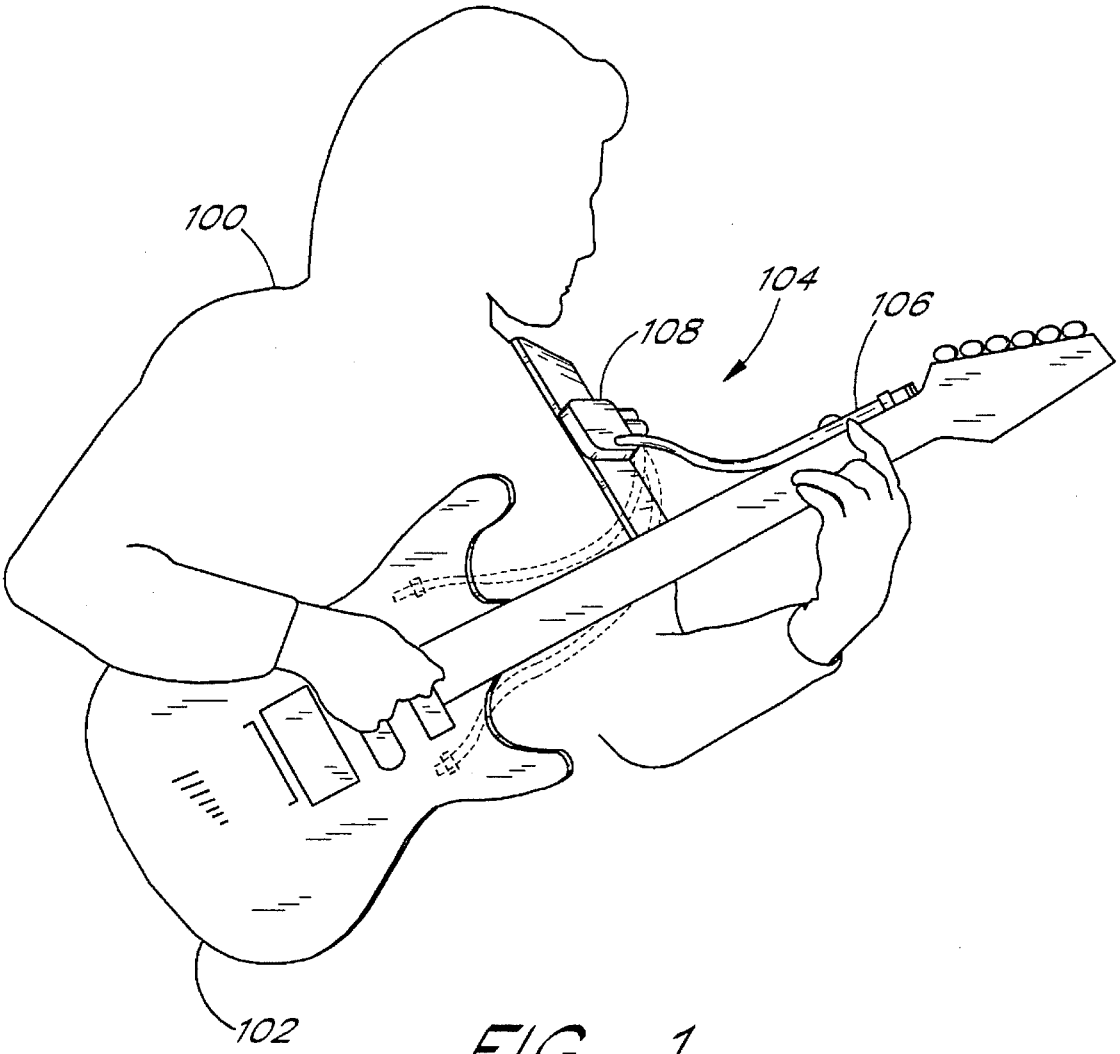
FIG. 1 is a perspective view of a musical instrument used in conjunction with a first embodiment of a control system of the present invention.
Figure 2:
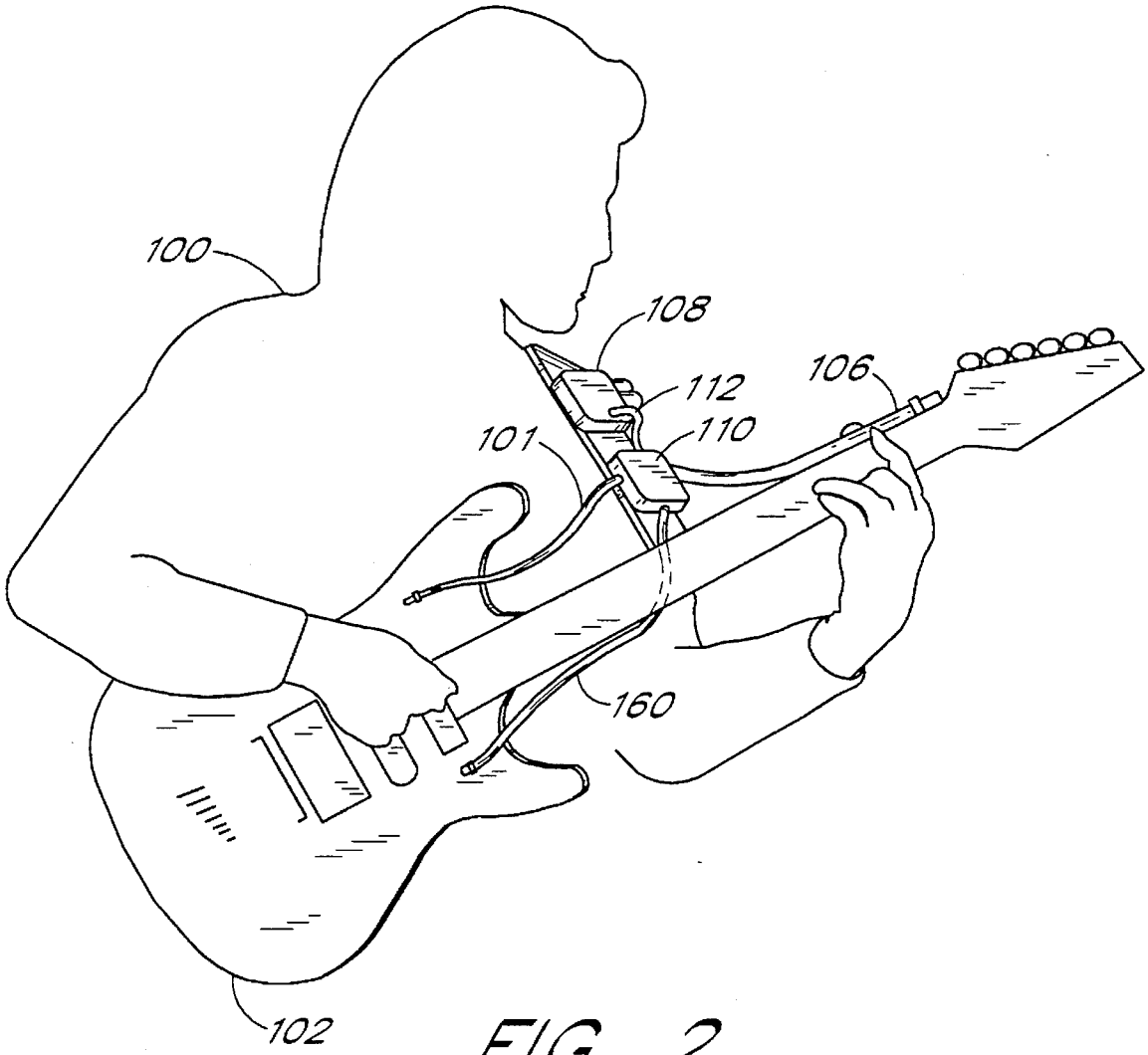
FIG. 2 is a perspective view of the musical instrument shown in FIG. 1, used in conjunction with a second embodiment of a control system of the present invention.

Reference will now be made to the drawings wherein like numerals refer to like parts throughout. FIGS. 1 and 2 illustrate a musician 100 holding a musical instrument 102, which in this case is an electric guitar. The musical instrument 102 is equipped with a music control system 104 of the preferred embodiment.

The music control system 104 includes one or more flexible tactile members 106 that are positioned on the musical instrument 102. The flexible tactile members 106 are preferably positioned on the musical instrument 102 in places where the musician 100 can exert pressure on the flexible tactile members 106 without the musician 100 removing his hands from playing positions on the musical instrument 102. In this embodiment, the tactile member 106 is positioned adjacent the neck of the guitar where the musician 100 can press down in the tactile member 106 with either his thumb or finger. Alternatively, the tactile member 106 could have been positioned adjacent the musician's strumming hand (shown in phantom) thereby allowing the musician 100 to use his strumming hand to exert pressure on the tactile member 106.

In the preferred embodiment, the tactile member 106 is a sealed air hose that the musician 100 can depress to thereby change the pressure within the air hose. The tactile member 106 is connected to a central control box 108 that has a sensor which determines the extent to which the musician has depressed the tactile member 106.

FIG. 2 illustrates a second embodiment of the invention wherein the tactile members 106 all are connected to a central manifold 110. The central manifold 110 is preferably connected to the central control box 108 via a connecting member 112. In the preferred embodiment, the connecting member 112 is a pressure hose which transmits the pressure from the tactile members 106 to the control box 108. The central manifold 110 is preferably selectable so that the musician 100 can select which of the plurality of tactile members 106 that is going to be used to transmit signals to the control box 108. Hence, the central manifold 110 allows the musician 100 to change between tactile members 106 as needed.

Figure 3A:
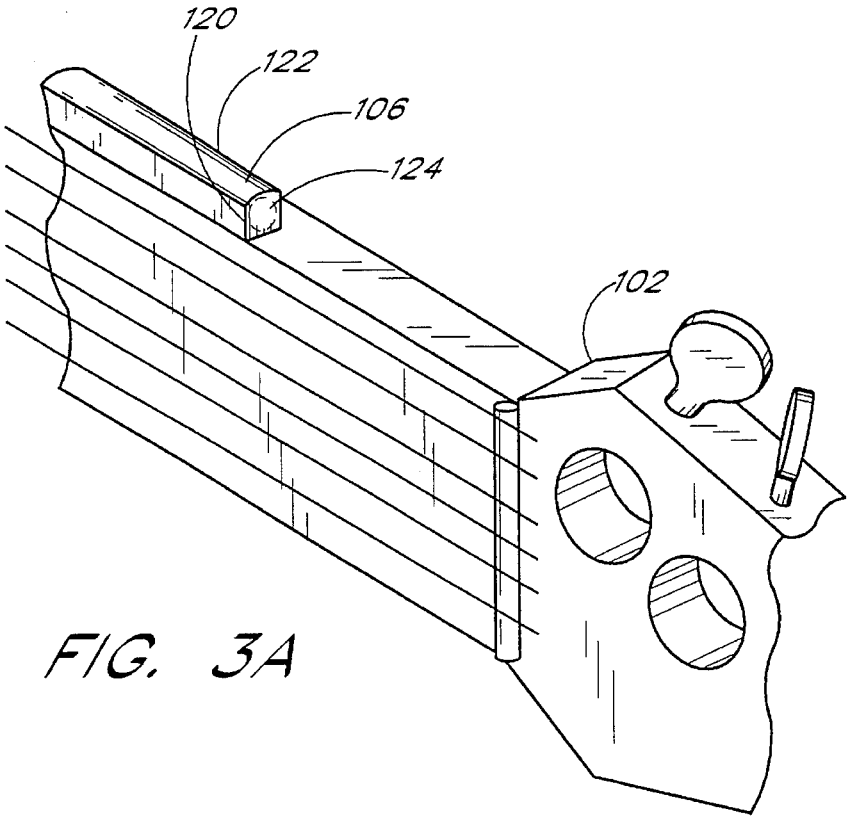
FIGS. 3A and 3B are partially cut-away perspective views of a tactile member which forms a portion of the control system shown in FIGS. 1 and 2.
Figure 3B:
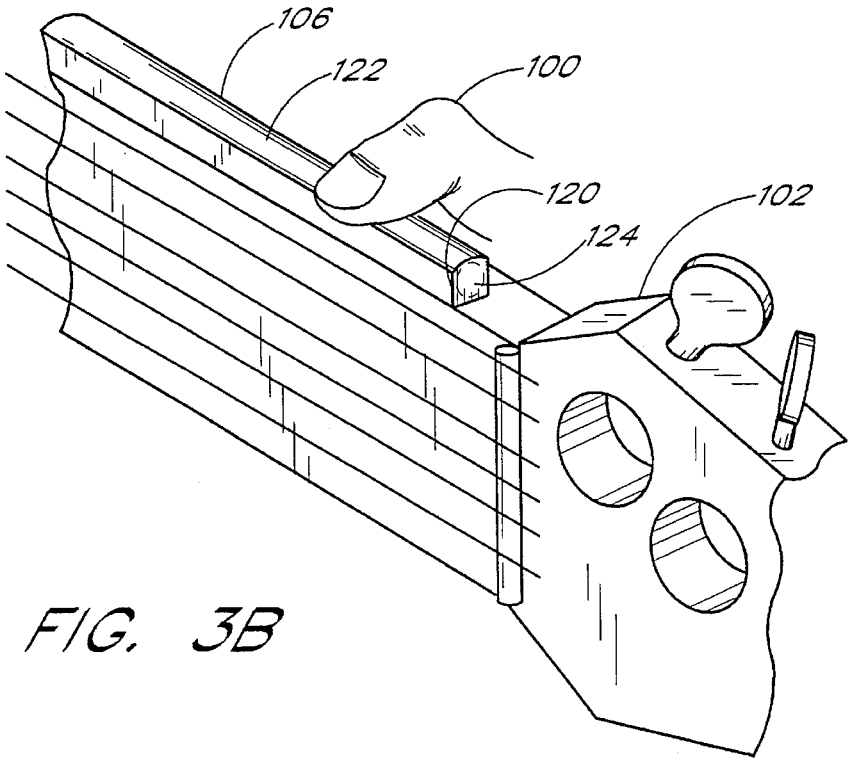

FIGS. 3A and 3B illustrate the tactile member 106 of the preferred embodiment in greater detail. FIG. 3A shows the tactile member 106 in a non-depressed state and FIG. 3B shows the tactile member 106 is a depressed state. As shown, the tactile member 106 has a square base 120 that is preferably ¼" by ¼" and a rounded upper surface that is formed from a hemisphere 122 positioned on the square base 120 that has a radius of approximately ¼". The tactile member 106 also has a central passage 124 that extends its full length that is roughly circular in cross section and has a diameter of ⅛". The tactile member 106 is made out of a substantially air-tight material so that depression of any one portion of the tactile member 106 results in a proportionate change in pressure inside the central passage 124 of the tactile member 106.

In the preferred embodiment, the tactile member 106 is made out of neoprene rubber that has been coated on both the outside surface and the inside surface of the central passage 124 with urethane to prevent leakage of air through the neoprene material. Neoprene material of the above-dimensions is preferred as it has a tactile feel which allows the musician 100 to depress the material to a known depth. Specifically, in the preferred embodiment, the tactile member 106 exerts a known, predictable amount of force against the finger of the musician when the musician is depressing the tactile member 106 until the point where the central chamber 124 of the member 106 has been pinched off. Hence, the musician 100 can become acquainted with the extent to which he must depress the tactile member 106 to produce a given change in pressure within the tactile member 106.

The tactile members 106 are preferably glued to the surface of the musical instrument 102 so that they project outward from the musical instrument 102 in the positions shown in FIGS. 1 and 2. This further facilitates the musician 100 in depressing the tactile member 106 in a controlled fashion as it allows the musician 100 to depress the tactile member 106 towards a surface. Since the tactile members 106 are positioned on the outer surfaces of the musical instrument 102, the musician 100 can position the members 106 in a desired location and change the position of the members whenever he desires by simply removing the member from one location and gluing it to another.

Figure 4:
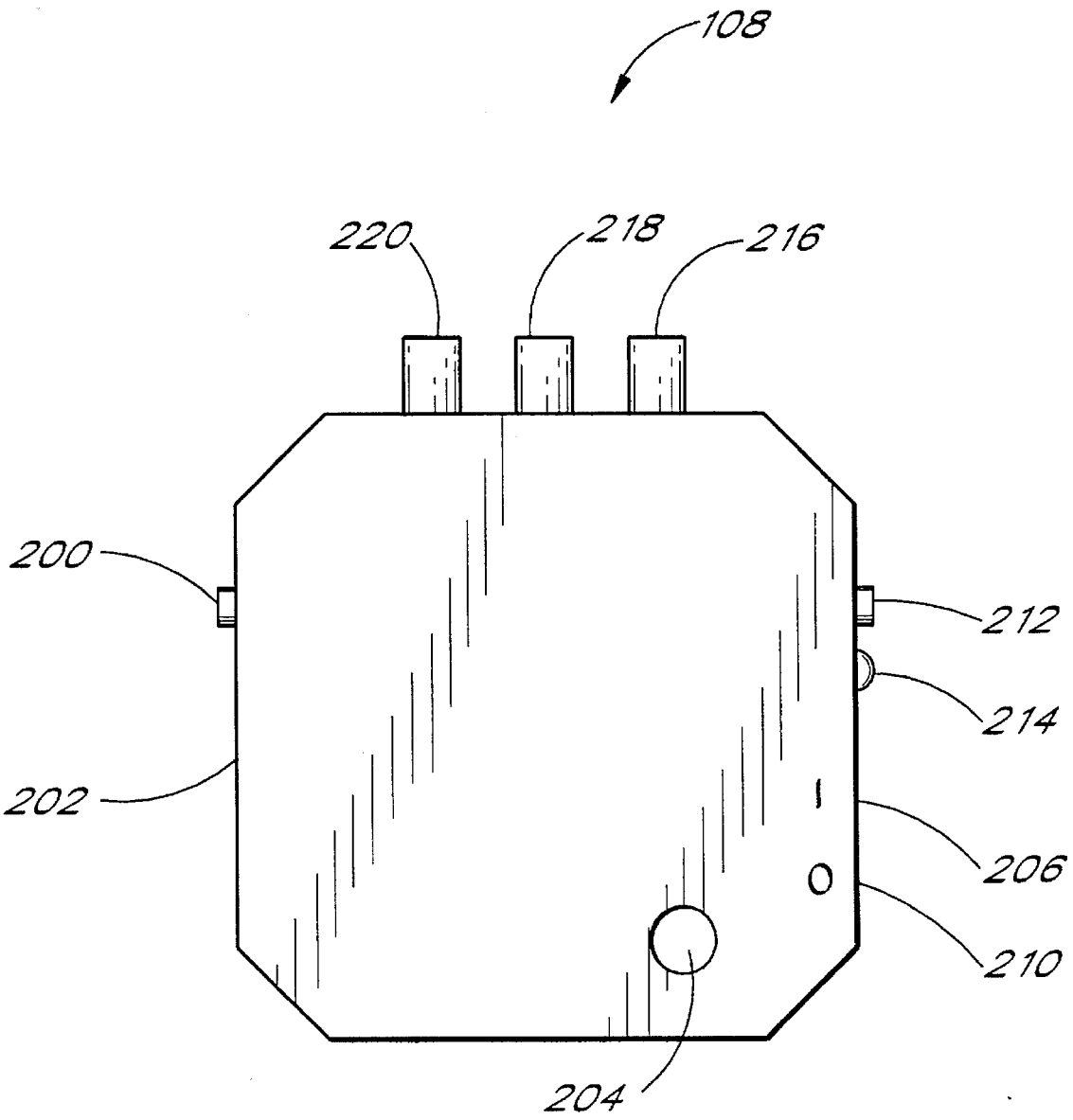
FIG. 4 is a perspective view of a control box, and the external controls associated therewith, comprising a portion of the control system of the present invention.

FIG. 4 illustrates the control box 108 in greater detail. Specifically, the control box 108 includes a power on-off switch 200 and an auxiliary power port 202. The control box 108 preferably includes an internal battery (See, FIG. 5) but is equipped to operate on either batteries or from an external power source.

The control box 108 also includes a tube input 204 to receive the pressure signal from the tactile member 106 and an electrical input 206 which receives the audio signal from the musical instrument 102. In the preferred embodiment, the musical instrument is an electric guitar which produces an electrical signal indicative of the notes played on the strings via a plurality of magnetic pickups associated with the strings. The electrical signal from the musical instrument 102 is then processed by the control box 108 in the manner described hereinbelow and an output signal is then provided via an electrical output 210 to a sound system, e.g., an amplifier (not shown), wherein an audio signal is produced.

The control box 108 also includes a program mode select button 212 and a program mode LED 214. The program mode select button 212 enables the musician 100 to program the control box 108 to perform manipulations to the audio signal produced by the musical instrument using a plurality of select buttons 216, 218 and 220. The select buttons include the volume select button 216, the tremolo speed select button 218 and the tremolo depth or amplitude button 220. The operation of these buttons varies depending upon whether the control box 108 is in a program mode or in a play mode.

In the program mode, the volume select button 216 enables the musician 100 to program a set starting volume for the signal produced by the musical instrument 102. Further, in the program mode the tremolo speed select button 218 enables the musician 100 to program a plurality of different frequencies, i.e., speeds, for a tremolo effect on the sound signal produced by the musical instrument. Finally, in the program mode the tremolo depth button 220 enables the musician 100 to select a plurality of different amplitudes for a tremolo effect, e.g., volume levels, on the audio signal produced by the musical instrument 102.

In the play mode, the volume select button 216 can be selected by the musician 100 to induce the control system 104 to perform one of two functions. In the first function, the control system 104 modifies the audio signal produced by the musical instrument 102 so that the volume characteristic is dependent upon the pressure that the musician 100 is exerting on the tactile member 106. In the second function, the control box 108 modifies the audio signal produced by the musical instrument 102 so that the volume characteristic of the audio signals is sustained at a particular value. In this function, while the musician 100 is playing the instrument 102, he is depressing on the tactile member 106 thereby causing the volume characteristic to increase. The control system 104 sustains the volume characteristic at the volume that corresponds to the maximum amount of pressure that the musician 100 exerted on the tactile member 106.

Further, in the play mode, the tremolo speed select button 218 enables the musician 100 to select the frequency or speed of the tremolo effect as one of three preset frequencies. The preset frequencies are generally frequencies that the musician has preprogrammed into the control system 104 in the program mode as described above. The musician 100 is also capable of increasing the frequency from one of the pre-programmed frequencies by depressing on the tactile member 106. The control system 104 increases the frequency at a rate which is proportional to the amount of pressure exerted on the tactile member 106 by the musician 100.

Finally, in the play mode, the tremolo depth button 220 allows the musician 100 to change the volume, i.e., the amplitude, of the tremolo effect on the audio signal produced by the musical instrument 102. In the preferred embodiment, the musician 100 can change the volume between a plurality of different pre-programmed volumes.

Hence, the control box 108 permits the musician 100 to program various parameters for different sound characteristics and then, when playing the instrument, use the pre-programmed parameters to alter different sound characteristics. In the preferred embodiment, the volume select, tremolo speed select and tremolo depth select buttons 216, 218, 220 are all lighted by LEDs 216*a*, 216*b*, and 216*c* which facilitate the musician 100 in programming the control box 108 and using the control box 108 while playing the musical instrument 102.

Figure 5:
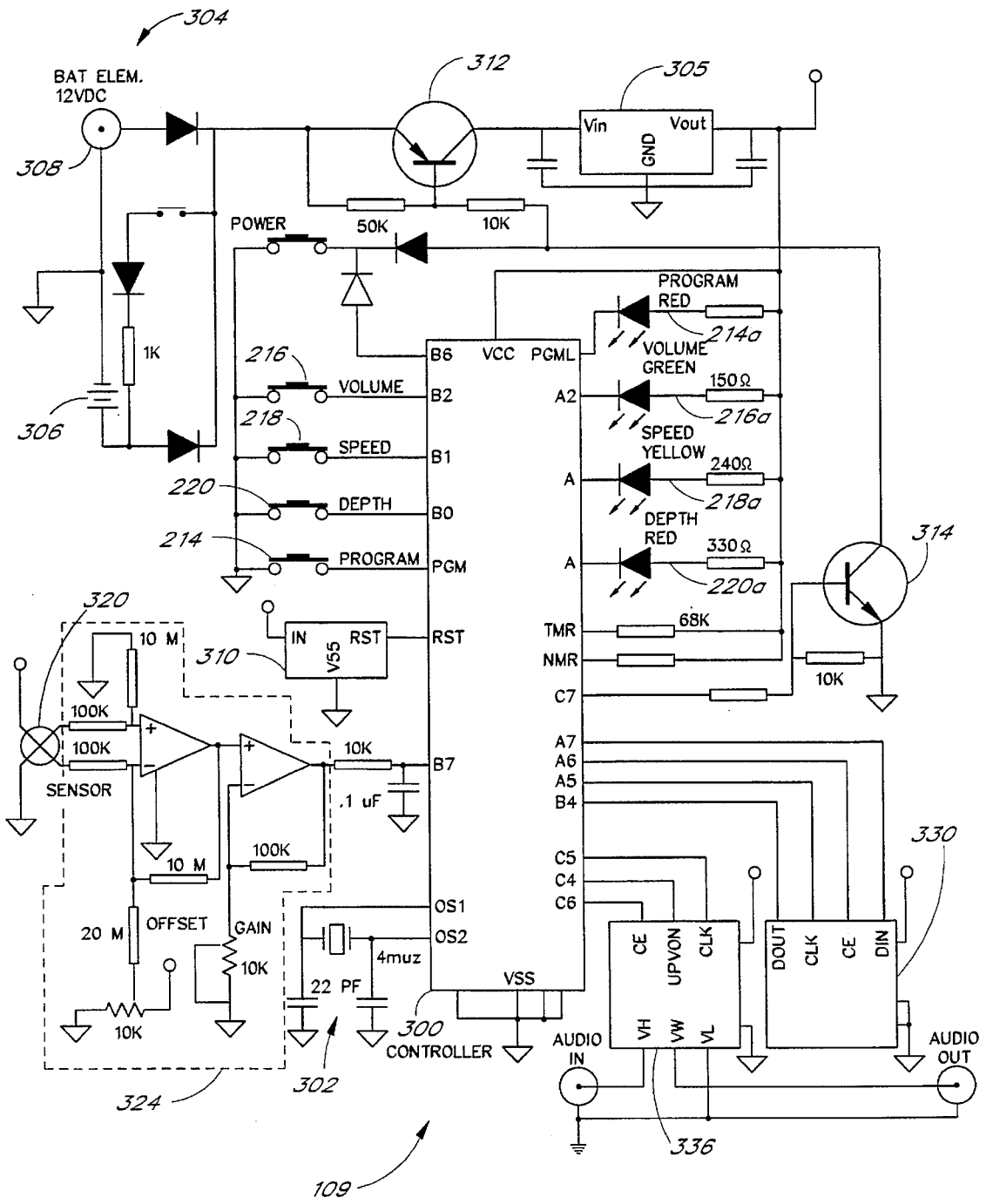
FIG. 5 is an electrical schematic which illustrates a control circuit which forms a portion of the control system shown in FIGS. 1 and 2.

FIG. 5 is an electrical schematic which illustrates the components of a control circuit 109 positioned in the control box 108 that enable the control system 104 to perform the above-described operations. The control circuit 109 includes a controller 300 which, in the preferred embodiment is an SGS Thompson ST 62T25 BG SWD microprocessor. The controller 300 receives a 4 MHz clock signal from a clock circuit 302.

The controller 300 further receives a power signal from a power circuit 304. The power circuit 304 includes a 9 volt battery 306 and a receptacle 308 configured to receive a 9 volt signal from an external source, e.g., an adaptor receiving 120 VAC. Preferably, the battery 306 is rechargeable and the circuit is configured so that the external source both powers the control circuit 109 and charges the battery 306. The power circuit 304 also preferably includes a regulator 305 which in this preferred embodiment is comprised of a 7805T-type regulator.

The controller 300 also receives a reset signal from a reset circuit 310 which in this preferred embodiment is a Seiko model 8074.5 reset circuit. The reset circuit 310 ensures that each time the controller 300 is powered up, the controller 300 initiates its programmed operation at the proper location. The microprocessor 300 also receive inputs from each of the select switches 216, 218, 220 which enable the musician 100 to program the controller 300 in the program mode and also to change the operation of the controller 300 in the play mode. Similarly, the controller 300 also receives an input signal from the program mode select switch 212 which places the controller 300 into the program mode.

The controller 300 also receives an input from the power switch 200 and the controller 300 uses the input from the power switch 200 to control two transistors 312 and 314 and some associated circuitry to turn the control circuit 109 off after a preselected period of time of no activity.

Finally, the controller 300 receives a pressure signal from a sensor 320 through an amplifier circuit 324. The sensor 320 is preferably a Motorola type MPX2010 pressure transducer that senses the changes in pressure resulting from when the musician 100 has depressed the tactile member 106 via the tube connection 204 shown in FIG. 4. The sensor 320 is preferably a very sensitive pressure transducer that is capable of recognizing very slight changes in pressure as a result of the musician 100 depressing the tactile member 106.

The signal produced by the sensor 320 is passed through the amplifier circuit 324. The amplifier circuit 324 is a typical operational amplifier circuit which is configured to transform the signal produced by the sensor 320 into a signal which is acceptable to the controller 300. The amplifier circuit 324 includes two type LT1078 operational amplifiers with an associated feedback network that includes variable offset and variable gain resistors.

The control circuit 109 in the control box 108 also includes a memory 330 wherein the preset values recorded by the musician 100 when programming the control system 104 are stored. In the preferred embodiment, the memory 330 is a type 93C46 EE RAM that is capable of storing data in the absence of a power source. Hence, the values stored in the memory 330 are not lost when power to the control box 108 is lost.

The controller 300 also provides output signals to four LEDs 214, 216*a*, 218*a* and 220*a* which are preferably positioned inside of the switches 212, 216, 218 and 220 shown in FIG. 4. The controller 300 illuminates the LEDs to assist the musician 100 in programming the control box 108 and in using the control system 104 in the manner that is described in greater detail in reference to FIGS. 6–12 below.

The controller 300 also provides output control signals to an audio signal modifier 336 which, in this preferred embodiment, is a digital potentiometer, Xicor Model X9104P potentiometer that, in response to receiving a digital signal from the controller 300, alters a resistive network within the digital potentiometer 336. The modifier 336 receives the audio input signal from the musical instrument 102 via the input 208 in the control box 108 (FIG. 4). The audio input signal is then modified by the modifier 336 in response to the control signals from the controller 300 and the modified audio output signal is then provided to the audio output 210 (FIG. 4) where it is then sent to an audio sound system.

The controller 300 thus receives a pressure signal from the sensor 320 and, in response to a pre-programmed instruction set contained within the controller 300 and preset selected values contained within the memory 330, modifies the audio, i.e., sound, signal from the musical instrument. The component values necessary to ensure proper operation of the control circuit 109 are listed adjacent the devices shown in FIG. 5.

The process by which the controller 300 is programmed to modify the audio input signal and the process by which the controller modifies the audio input signal when the musician is playing the musical instrument 102 will now be described in reference to the flow charts shown in FIGS. 6–12A. The flow charts in these figures are simply illustrative of one preferred method of programming the controller 300. It will be appreciated by a person skilled in the art of programming that the flow charts are simply visual illustrations of the general process performed by the system 104.

Figure 6:
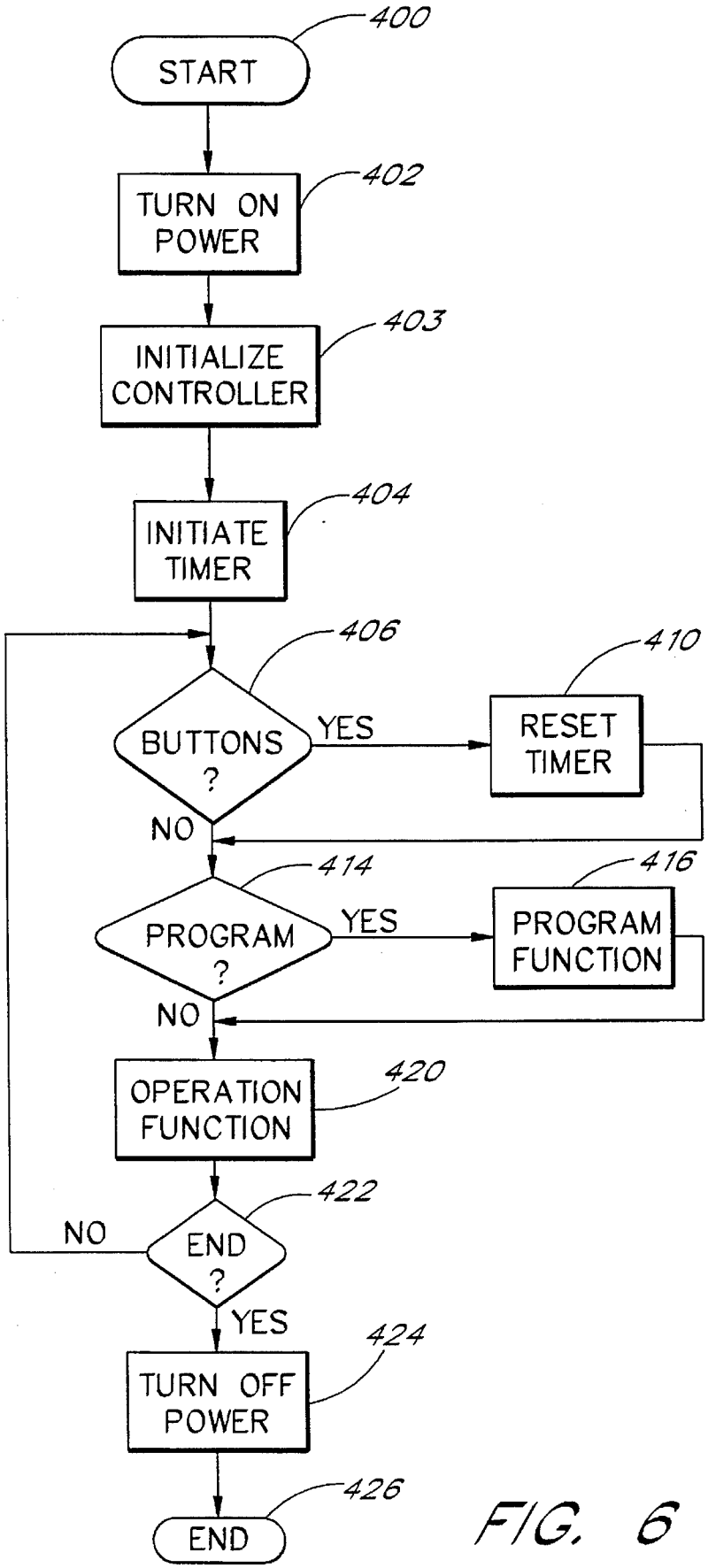
FIG. 6 is a flow chart illustrating the operation of the control circuit shown in FIG. 5.

Referring now to FIG. 6, the overall operation of the control system 104, and the controller 300 in particular, will be described. The controller 300 begins in a start state 400 wherein it is waiting for the musician 100 to activate the system. The musician 100 activates the system 104 by manipulating the power switch 200 (FIG. 4). Once the switch 200 has been activated, the control system 104 enters state 402 where power is supplied to the components of the system 104 including the controller 104. Upon receiving power, the controller 104 is initialized in state 403 by the reset circuit 310.

The controller 300 then initiates a timer in state 404, using the timing circuit 302 as an input, which determines whether to automatically turn the system 104 off to conserve the battery. In the preferred embodiment, the controller 300 is programmed to turn the system 104 off by sending an appropriate signal to the transistors 312 and 314 (FIG. 5) when there has been no activation of the buttons 214–220 for a period of an hour. Hence, the controller 300, in decision state 406 determines whether the buttons 214–220 have been activated and each time it detects that the buttons have been activated, it reset the timer in state 410.

Once the controller 300 has initiated the timer and checked for activation of the buttons, the controller 300 then determines in decision state 414 whether to enter a program mode or an operation mode. If the musician 100 wants to program the controller 300, he manipulates the program mode select button 212 (FIG. 4) causing the controller 300 to enter into a program function 416. The program function 416 allows the operator to program various preset frequencies and present amplitudes for tremolo characteristics to be applied to the sound signal produced by the musical instrument 102 and also to program a starting volume for the volume characteristic of the sound signal. The program function 416 will be described in greater detail in reference to FIGS. 10–12 hereinbelow.

If the musician has not manipulated the program button 212, the controller 300 enters an operation function 420. In the operation function 420, the musician 100 can use the system 104 to modify the characteristics of the sound signal produced by the musical instrument 102 in accordance with either the characteristics programmed by the musician 100 in the program function or the default characteristics provided by the manufacturer. The operation function 420 will be described in greater detail in reference to FIGS. 7–9 hereinbelow.

The controller 300 also determines in decision state 422 whether the system operation has ended. In the preferred embodiment, the system operation will end in response to the musician moving the power switch 200 (FIG. 4) to the off position or by the controller 300 determining that there had not been any keystrokes in the last hour. In either of these circumstances, the controller 300 then powers down in state 424 and proceeds to an end state 426. However, if system operation has not ended, the controller 300 returns to decision state 406 wherein the loop comprising the states 406–422 is repeated until operation does end. Hence, the controller 300 can enter either the operation or program function 416, 420 at any time that the system 104 is activated.

Figure 7:
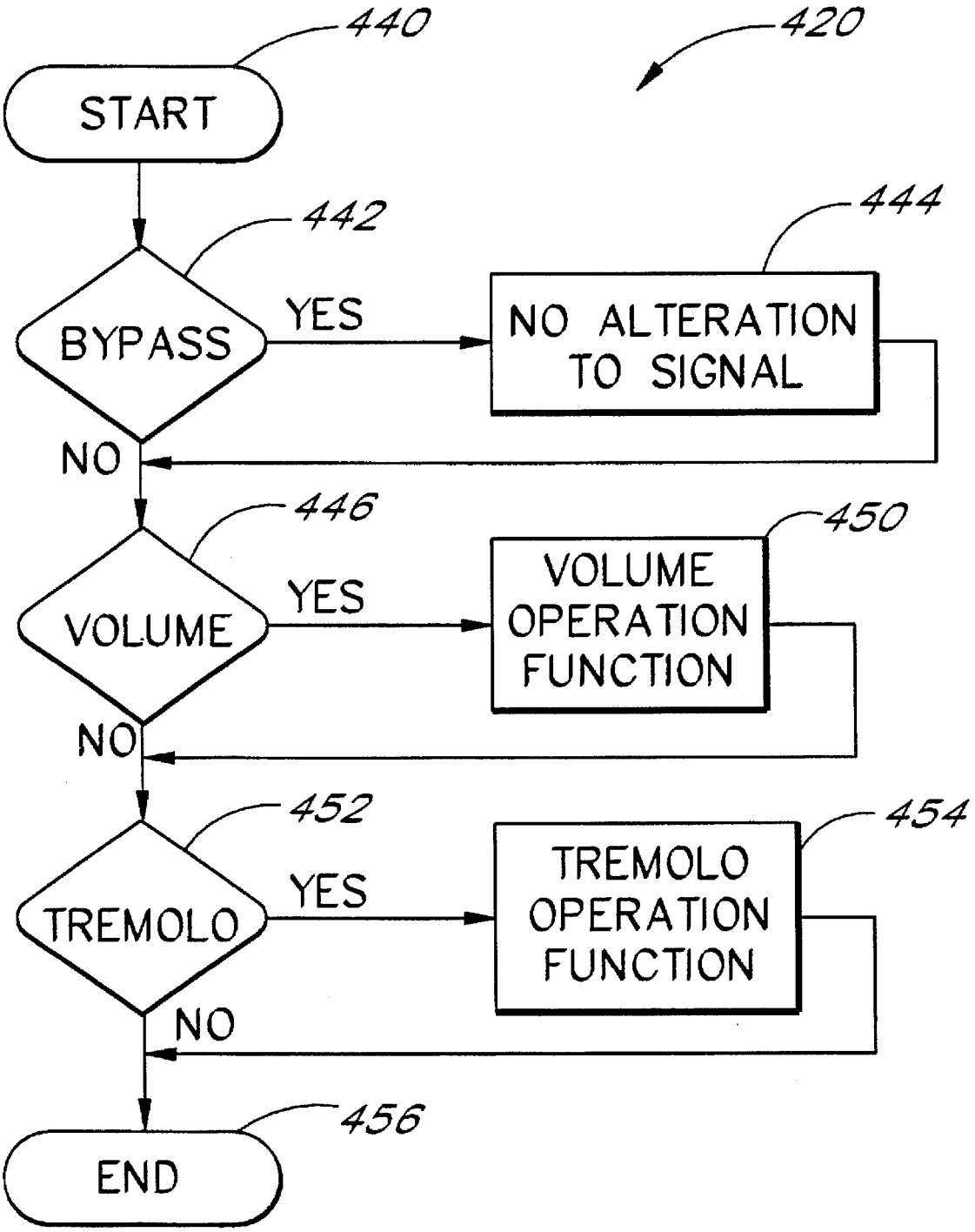
FIG. 7 is a flow chart illustrating the operation of the control circuit as it performs an operation function shown in FIG. 6.

The operation function 420 will now be described in reference to FIGS. 7–9. FIG. 7 illustrates the basic operation of the controller 300 in the operation function 420. Specifically, the controller 300 initially determines in decision states 442 which operating mode has been selected by the musician 100. The musician 100 has the option of selecting a bypass mode and, if the controller 300 determines in decision state 442 that the musician has selected a bypass mode, it then enters a bypass state 444. In the bypass state 444 the characteristics of the audio signal produced by the musical instrument 102 are not adjusted or attenuated by the control system 104. In this embodiment, the musician 100 can select the bypass mode by depressing either the volume button 216 once or the tremolo speed and depth buttons 218, 220 once simultaneously.

The musician 100 also has the option of selecting the volume mode of operation by depressing the volume button 216 (FIG. 4). If the controller 300 determines in decision state 446 that the musician has entered the volume mode, it then proceeds to a volume operation function 450 wherein the volume characteristic of the audio signal produced by the musical instrument is adjusted by the control system 104. Specifically, as will be discussed in greater detail below in reference to FIG. 8, the control system 104 allows the musician 100 to change the volume characteristic of the audio signal by depressing the tactile member 106 to different degrees.

The musician 100 also has the option of selecting the tremolo mode of operation by depressing the tremolo speed button 218 simultaneously with the tremolo depth button 220 (FIG. 4). If the controller 300 determines that the musician 100 has selected the tremolo mode of operation in decision state 452, the controller 300 enters a tremolo operation function 454 wherein a tremolo characteristic is added to the audio signal from the musical instrument 100. The tremolo characteristic modifies the audio signal produced by the musical instrument 102 so that the resulting audio signal is a constant volume that repeats itself at a given frequency, which in this embodiment is between 1 and 15 Hz.

Once the controller 300 has decided the operational mode of the system 104 and has carried out the function associated with the selected operational mode, the controller 300 then proceeds to an end state 456 from which the controller 300 returns to the flow in decision state 422 (FIG. 6).

Figure 8:
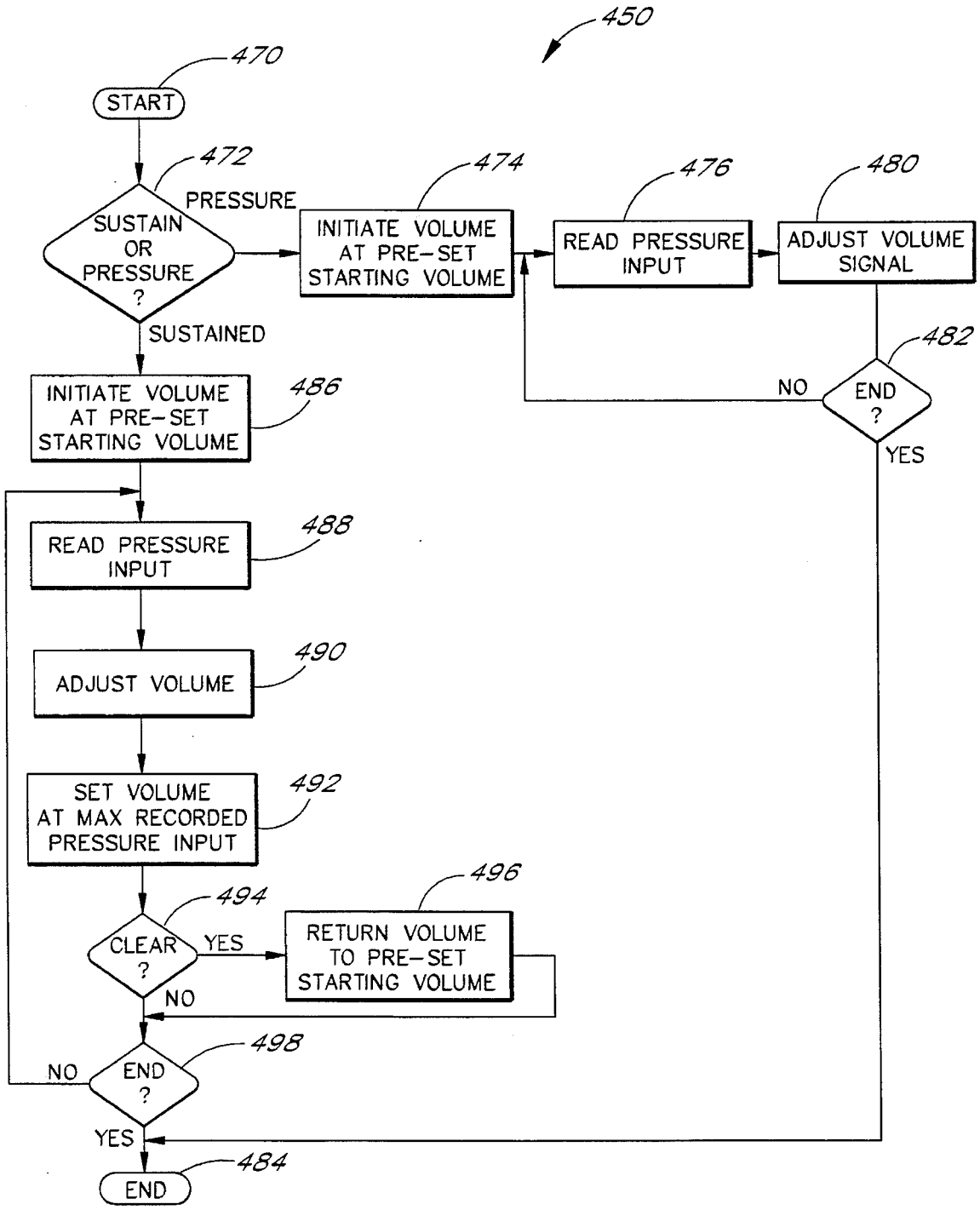
FIG. 8 is a flow chart illustrating the operation of the control circuit as it performs a volume operation function shown in FIG. 7.

FIG. 8 is a flow chart which illustrates the volume operation function 450 shown in FIG. 7. In this function, the controller 300, from a start state 470, determines in decision state 472 whether the control system 104 is in a pressure mode or in a sustained mode. The musician 100 can select the pressure mode by depressing the volume select switch 216 once following entering the volume operation function 450.

This causes the controller 300 to send a signal in state 474 to the signal modifier 336 to change the volume characteristic of the audio signal from the musical device to a preprogrammed volume value. The preprogrammed volume value can either be set by the musician in the program function 420, as will be described below, or it can be pre-set at the factory. The preprogrammed volume characteristic is usually represented as a percentage of the maximum volume available in the system, which in the preferred embodiment is 50 dB, and is stored in the memory 330 (FIG. 5).

Hence, the system 104 is outputting an audio signal to the sound system (not shown) that has the preprogrammed volume characteristic. The musician 100 can hear the sound signal produced by the sound system having the volume characteristic. In the pressure mode, the musician 100 can increase the volume characteristic of the audio signal by depressing the tactile member 106. Preferably, the increase in the volume characteristic is linearly related to the amount of pressure that is applied to the tactile member 106.

The controller 300 receives a signal in state 476 from the sensor 320 (FIG. 5) which is indicative of the amount of pressure the musician 100 is exerting on the tactile member 106. The controller 300 then uses this signal in state 480 to adjust the volume characteristic of the audio signal from the musical instrument 102 by sending an appropriate digital signal to the signal modifier 336 (FIG. 5). The controller 300 then determines in decision state 482 whether operation in the pressure mode of the volume operation function has ended. Operation in this mode ends if the musician turns off the device using the power switch 200 or if the musician selects a different mode of operation.

If the controller 300 determines that operation in the pressure mode has ended, it then proceeds to an end state 484. However, if the controller 300 determines that operation in the pressure mode is continuing in decision state 482, the controller 300 returns to state 476 where the pressure input from the sensor 320 is again read. Hence, the controller 300 in the loop comprising the states 476–482 allows the musician 100 to continuously vary the volume characteristic of the audio signal produced by the musical instrument 102. It can be appreciated that since the tactile member 106 is adjacent the playing surfaces of the musical instrument 102, the musician 100 can vary the volume of the audio signal without removing his hands from the instrument.

Alternatively, the musician can select a sustained mode of operation in the volume operation function 450 by depressing the volume select button 216 twice when the control system 100 is in the operation function 420. If the controller 300 determines that the musician 100 has selected the sustained mode of operation in decision state 472, the controller 300 proceeds, in state 486, to adjust the volume characteristic of the audio signal to the preprogrammed volume characteristic value stored in memory in the same manner as was described in reference to state 474.

Further, the controller 300 then reads the pressure input signal from the pressure sensor 320 in state 488 and adjusts the volume characteristic in state 492 in response to the signals from the pressure sensor 320 in the same manner as previously described. However, in state 492, the controller 300 latches or sets the volume characteristic at the highest volume characteristic sampled. The volume characteristic remains latched at the highest volume characteristic regardless of whether the musician 100 exerts pressure on the tactile member 106 until the controller 300 determines in decision state 494 that the musician 100 has sent a clear signal or the controller 300 determines in decision state 498 that the musician 100 has ended the sustained mode of operation.

While the system 104 is in the sustained mode of operation, the musician 100 can halt the sustained or latched volume characteristic by depressing the tactile member 106 (FIGS. 1 and 2) in such a way that the controller 300 is commanded to end the sustained volume characteristic. In the preferred embodiment, the musician 100 can send the clear signal by exerting 51% of the pressure on the tactile member 106 corresponding to the latched volume characteristic. This results in the controller 300 sending a signal in state 496 to the signal modifier 336 to return the volume characteristic to the pre-set volume characteristic.

Alternatively, the controller 300 leaves the sustained mode of operation in response to determining in decision state 498 that the musician 100 has selected a different mode of operation or has turned the system 104 off. Hence, the control system 104 allows the musician 100 to vary the volume characteristic of an audio signal produced by the musical instrument, and also to sustain this volume at a set level, without removing his hands from the musical instrument.

Figure 9:
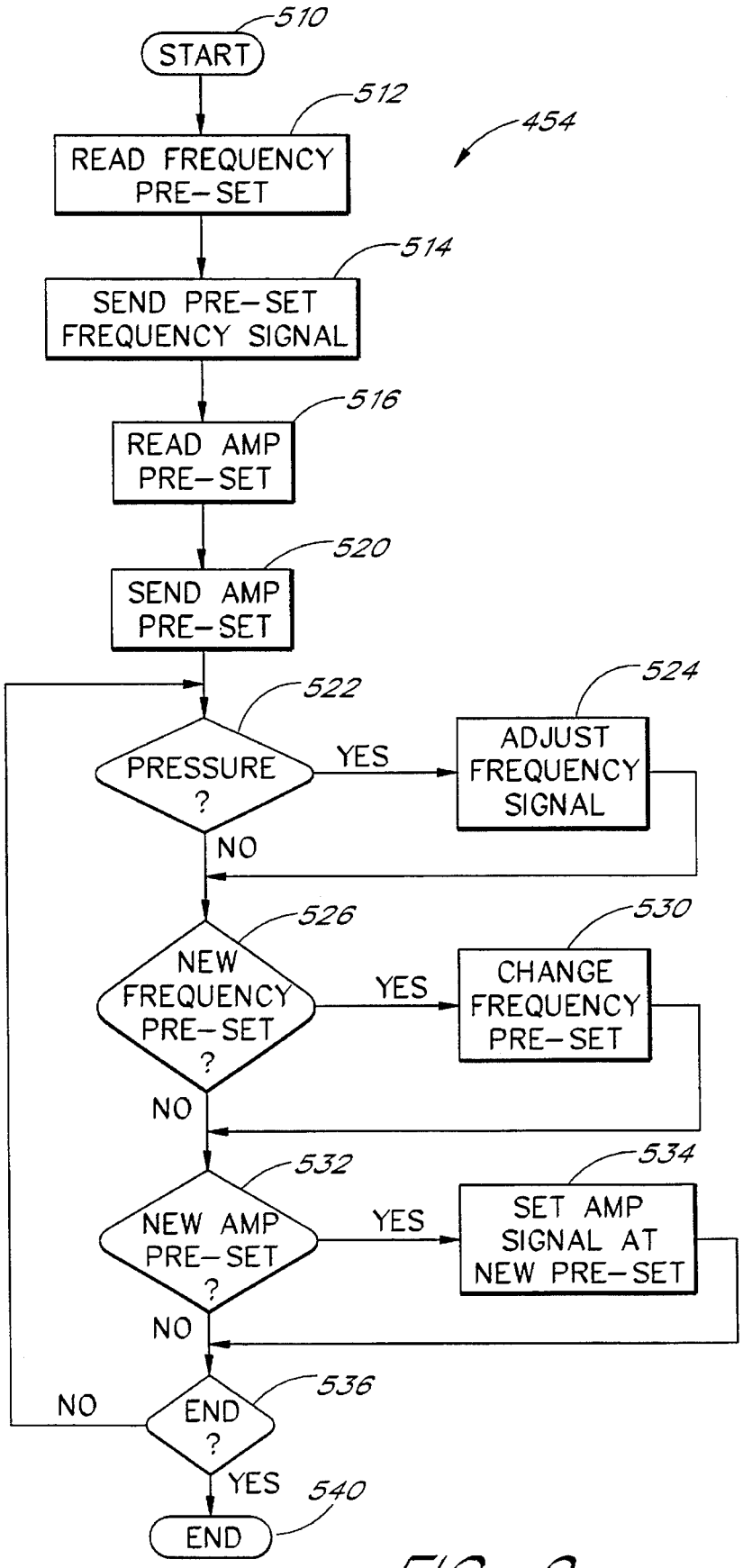
FIG. 9 is a flow chart illustrating the operation of the control circuit as it performs a tremolo operation function shown in FIG. 7.

FIG. 9 is a flow chart which illustrates the operation of the control system 104 as it performs the tremolo operation function 454. From a start state 510, the controller 300 initially recalls the selected frequency preset characteristic in state 512. As will be described hereinbelow, the musician 100 can preset up to three separate tremolo frequency characteristic values when programming the tremolo frequency characteristic. Subsequently, the musician 100 can then select these preset values by depressing the tremolo speed button 218 (FIG. 4) one, two or three times. Depending upon the number of times the musician 100 has depressed the frequency select button 218, the controller 300 recalls the appropriate frequency characteristic from the memory 330 and then sends an appropriate signal in state 514 to the audio signal modifier 336 (FIG. 5).

Similarly, in state 516, the controller 300 recalls out of the memory 330 the preset amplitude, i.e., volume, corresponding to the number of times that the musician has depressed the tremolo depth switch 220. As will be described in greater detail below, the musician can also program up to three separate amplitudes for the tremolo characteristic to be applied to the audio signal. Once the controller 300 has recalled the preset amplitude for the tremolo characteristic, it then sends in state 520 an appropriate signal to the signal modifier 336.

Hence, in the tremolo operation function 454, the audio signal produced by the musical instrument 102 is modified by a tremolo characteristic that can be preprogrammed by the operator. The tremolo characteristic is comprised of one of three amplitude characteristics and one of three frequency characteristics that were preset by the musician 100 and then selected while the musician 100 plays the instrument 102.

The controller 300 then determines in decision state 522 whether pressure is being applied to the tactile member 106. If pressure is being applied, the frequency component of the tremolo characteristic is adjusted in state 524 to an extent corresponding to the amount of pressure exerted on the tactile member 106. Hence, the musician 100 can control the frequency component of the tremolo characteristic by manipulating the tactile member 106. This allows the musician to dynamically vary the audio signal produced by the musical instrument 102 while playing the instrument.

The controller 300 also determines in decision state 526 whether the musician 100 has selected a new frequency preset while playing the instrument. The musician 100 can select a different frequency preset while playing the instrument 102 by depressing the tremolo speed button 218 (FIG. 4). This causes the controller 300 to recall the preset frequency component value, corresponding to the new position of the button 218, and send an appropriate signal in state 530 to the signal modifier 336 to thereby change the frequency component of the tremolo characteristic being applied to the audio signal.

Similarly, the controller 300 also determines in decision state 532 whether the musician 100 has selected a new amplitude preset while playing the instrument 102 by depressing the tremolo depth button 220 (FIG. 4). If the musician 100 has selected a new amplitude preset value, the controller 300 recalls the corresponding preset value from the memory 330 and sends an appropriate signal in state 534 to the signal modifier 336 to change the amplitude component of the tremolo characteristic being applied to the audio signal produced by the musical instrument 102.

The controller 300 then determines in decision state 536 whether the tremolo operation function 454 has ended. The tremolo operation ends and the controller enters an end state 540, when the musician 100 selects a different operating mode for the system 104 or turns the system 104 off. Otherwise, the controller 300 returns to decision state 522 to loop through states 522–536 in the previously described fashion. The controller 300 thus can apply a tremolo characteristic to the audio signal produced by the musical instrument that can be varied by the musician changing to different present frequencies and amplitudes using the buttons 218 and 220 (FIG. 4) or by dynamically varying the frequency using the tactile member 106 (FIG. 1).

The foregoing description has described how the controller 300 operates when the musician 100 is playing a musical instrument 102. The musician 100 can vary the volume characteristic of an audio signal produced by the musical instrument and can also apply a tremolo characteristic wherein the components of the tremolo characteristic can be selected from a plurality of preset or prerecorded components. Hence, in operation, the control system 104 of the preferred embodiment significantly enhances the ability of the musician 100 to easily change the audio signal produced by the musical instrument 102.

Figure 10:
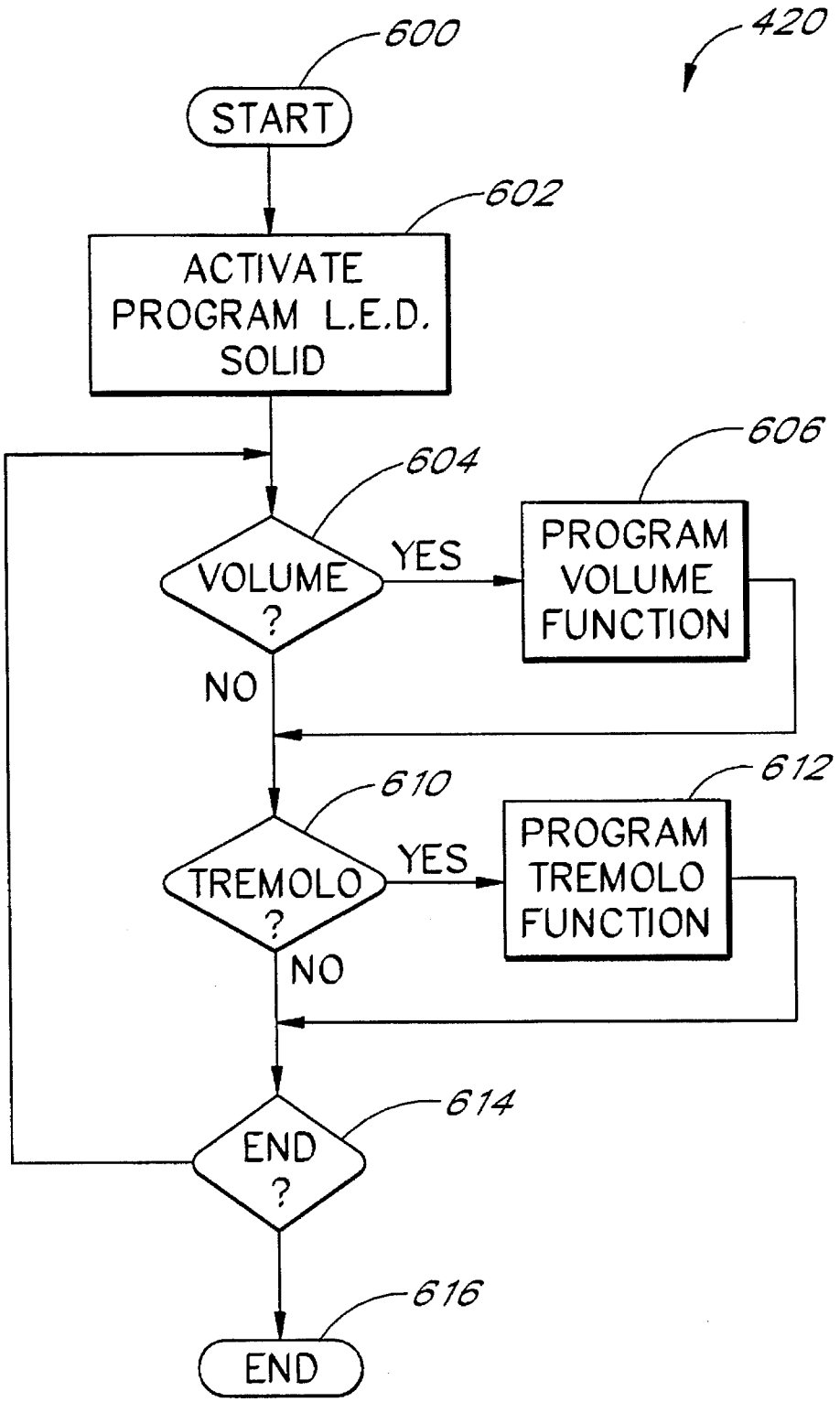
FIG. 10 is a flow chart illustrating the operation of the control circuit as it performs a program function shown in FIG. 6.
Figure 11:
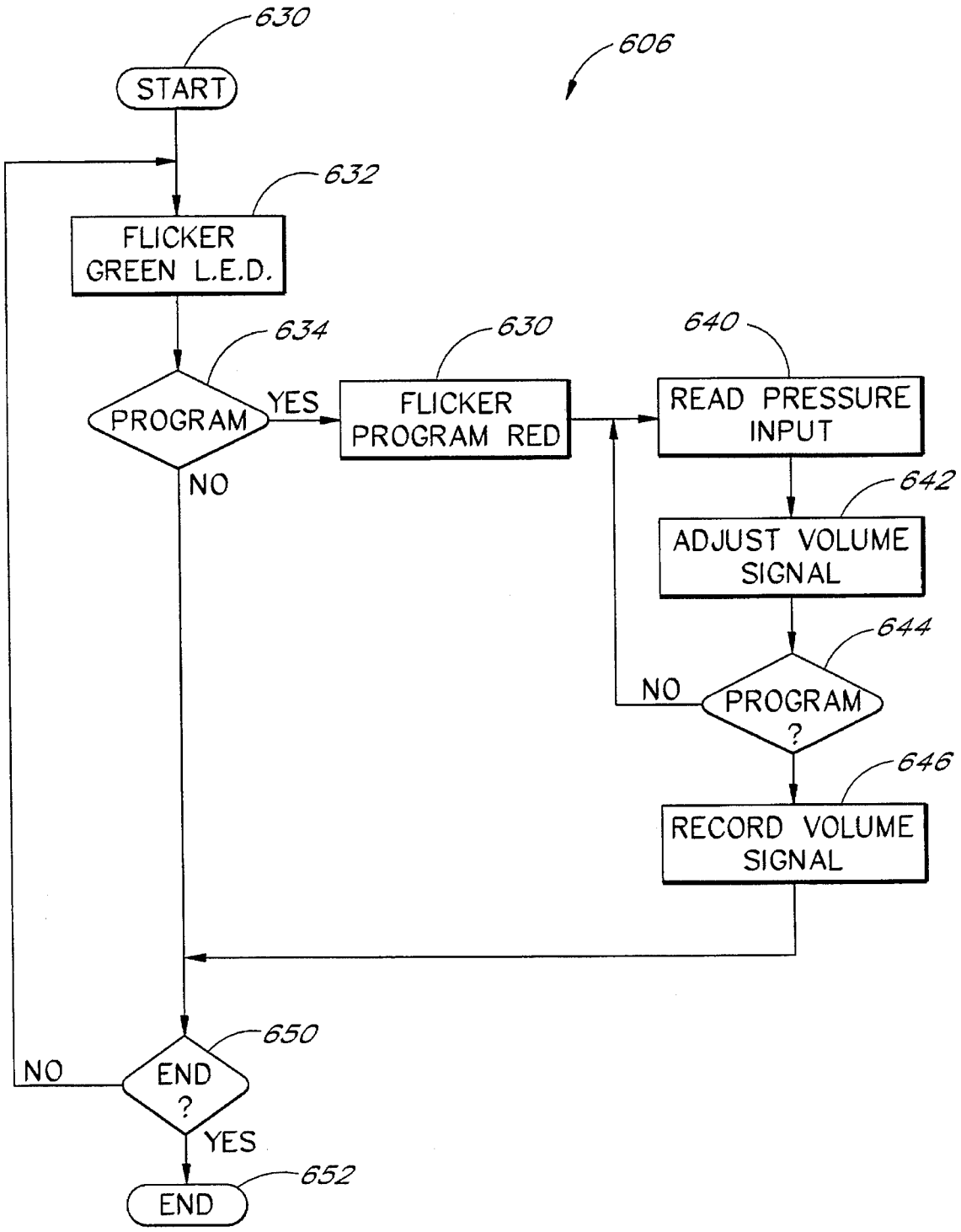
FIG. 11 is a flow chart illustrating the operation of the control circuit as it performs a program volume function illustrated in FIG. 10.
Figure 12A:
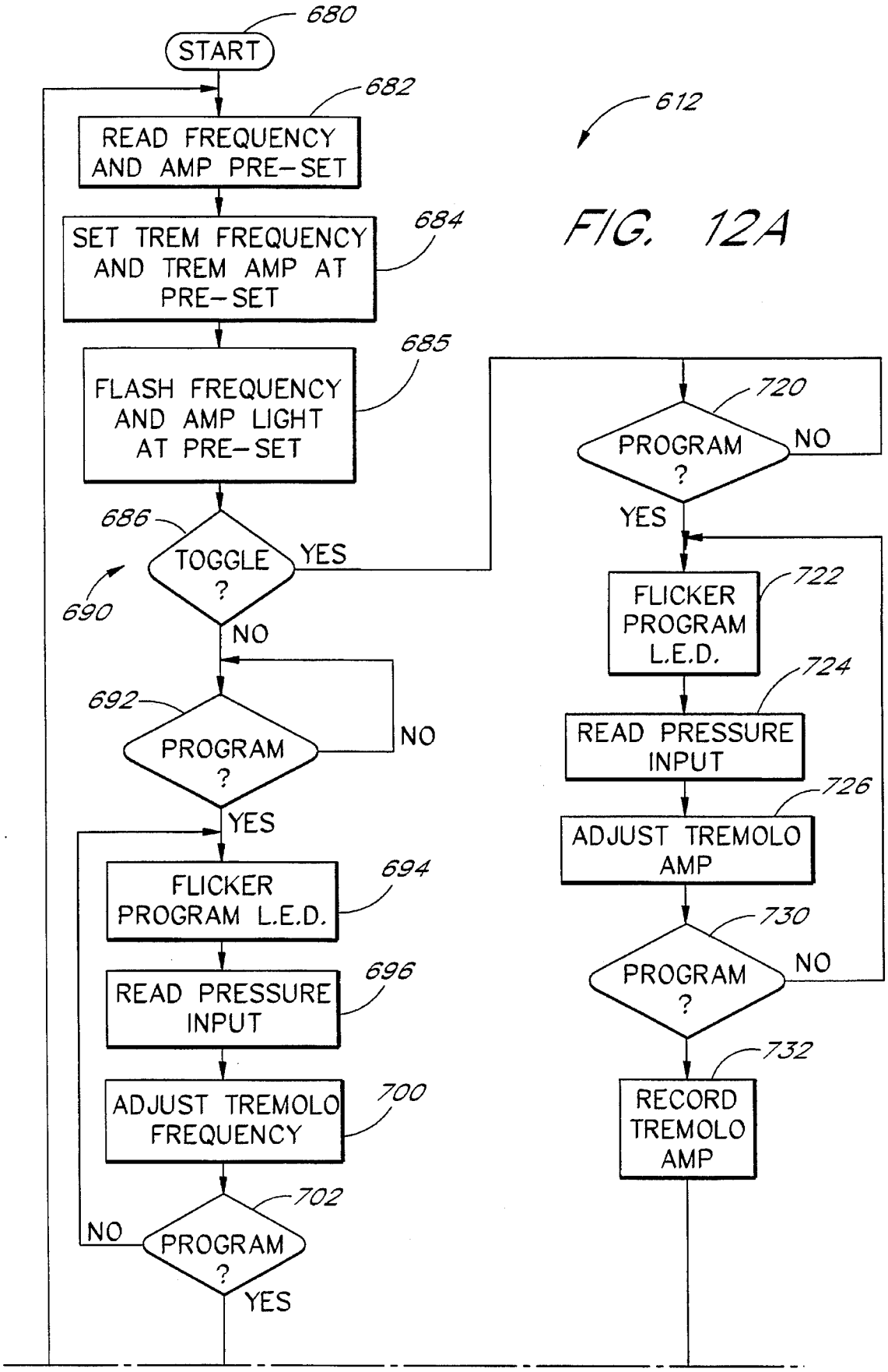
FIGS. 12 and 12A is a flow chart illustrating the operation of the control circuit as it performs a program tremolo function shown in FIG. 10.
Figure 12B:
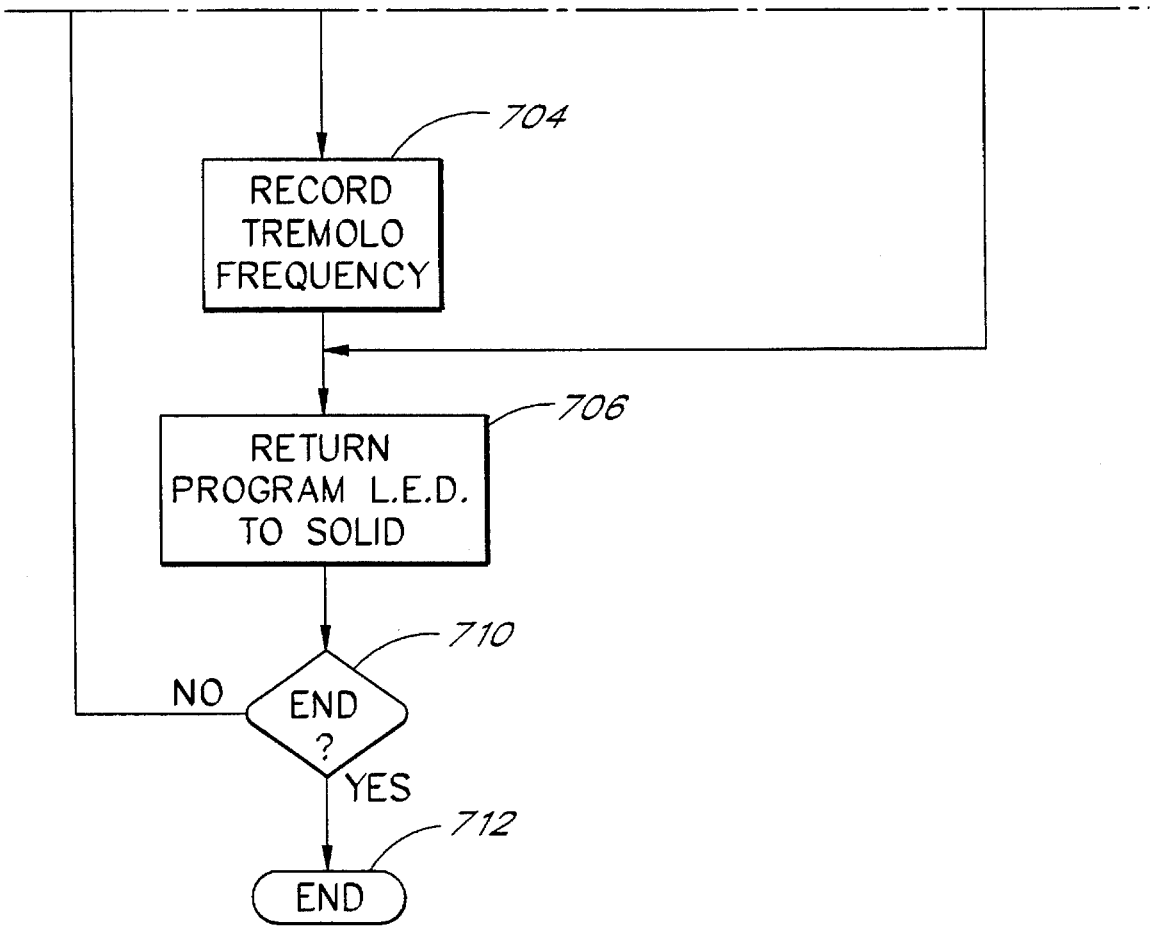

FIGS. 10–12 are flow charts which illustrate the operation of the controller 300 and the control system 104 when the musician 100 is programming volume characteristic and frequency and amplitude components of the tremolo characteristics. Referring initially to FIG. 10, the overall operation of the controller 300 in the program function 420 (FIG. 6) is shown. The controller 300 proceeds initially from a start state 600 to activate the program LED 214 in state 602. The program LED 214 is preferably activated so that it is a solid red. This provides the musician 100 with an indication that the control system 104 is in the program mode or performing the program function 420.

The controller 300 then determines in decision states 604 and 610 which program function the musician is going to select. The musician 100 can select to program the starting volume by depressing the volume select button 216 which would cause the controller 300 to enter the program volume function 600. The program volume function 606 enables the musician to set the initial starting volume characteristic value during operation of the control system 104 and is described in greater detail in reference to FIG. 11 hereinbelow.

The controller 300 also determines in decision state 610 whether the musician 100 has selected to program the components of the tremolo characteristic. The musician can select to program the tremolo characteristic by simultaneously depressing both the tremolo speed button 218 and the tremolo depth button 220 (FIG. 4) while in the program mode. This causes the controller 300 to enter the program tremolo function 612.

The controller 300 then determines whether the program function has ended in decision state 614. The program function 420 ends when the musician turns power switch 200 off or turns the program switch 212 (FIG. 4) to the operating position. If the controller 300 determines that the musician has not ended or exited the program function 420, the controller returns to state 604 to await further commands from the musician 100 via the buttons 216, 218 and 220. Otherwise the controller 300 enters an end state 616 wherein it returns to the flow at state 420 (FIG. 6).

FIG. 11 illustrates the program volume function 606 shown in FIG. 10. The program volume function 606 in this preferred embodiment allows the musician to set the initial volume characteristic for an audio signal produced by the musical instrument 102 when the system 104 is in the operating function 620. Advantageously, the musician 100 can program this volume characteristic by playing the musical instrument 100 and raising the volume using the tactile member 106 to a desired volume and then recording this volume.

Specifically, from a start state 630, the controller proceeds to induce the volume LED 216*a* (FIG. 5) to flicker. This informs the musician 100 that the system 100 is in the volume program function 606. The controller 300 then determines in decision state 536 whether the program button 216 has been depressed again by the musician 100. The musician 100 depresses the program button 216 again when he wants to program the initial volume characteristic. Once the musician had depressed the button 216, the controller 300 proceeds to state 636 wherein it causes the program LED 214 (FIG. 4) to flicker red at a fast rate. This informs the musician 100 that the initial volume characteristic is ready to be programmed.

The initial volume characteristic is programmed by the musician playing the instrument 102 and exerting pressure on the tactile member 106 causing the sensor 320 (FIG. 5) to send an appropriate signal to the controller 300 in state 640. The controller 300 then adjusts the volume characteristic in state 642, to correspond to the pressure input signal, by sending an appropriate signal to the signal modifier 330 (FIG. 5). This characteristic is then applied to the audio signal produced by the musical instrument 102 so that the musician 100 can hear the volume characteristic of the audio signal.

When the volume characteristic is acceptable to the musician 100, the musician manipulates the program switch 214 causing the controller 300 to record, in state 646, the initial volume characteristic in the memory 330. The controller 300 then determines whether the programming of the volume has ended in decision state 650. The program volume function 606 ends when the musician leaves the program mode or turns the device off causing the controller 300 to enter an end state 652.

Hence, the program volume function 606 enables the musician to set an initial volume characteristic of the audio signal by playing the musical instrument 102 and then setting the initial volume characteristic at a desired amount based upon what the musician hears.

FIG. 12 is a flow chart which illustrate the steps performed by the controller 300 when it executes the program tremolo function 612 (FIG. 10). From a start state 680, the controller 300 initially proceeds to read the frequency and amplitude presets for the tremolo characteristic in state 682. When programming a tremolo characteristic, the musician 100 enters the program mode and then simultaneously depresses the speed and depth preset buttons 218, 220 (FIG. 4). This induces the controller 300 to enter the program tremolo function mode. The musician 100 can then select which of the three preset positions for each of these buttons 218, 220 are to be programmed.

Once the musician 100 has selected the presets to program, the controller 300 then sets in state 684 the frequency component and the amplitude component of the tremolo characteristic at the preset values. In the preferred embodiment, there are pre-existing preset values always programmed into the control system 104 which are either previously programmed values entered by the musician 100 or default values entered at the factory. Hence, in state 684, a tremolo characteristic is produced that will be used to modify the audio signal produced by the musical instrument 102 while the musician 100 is playing the musical instrument 102 to program a new desired tremolo characteristic. The controller 300 then induces the LEDs 218*a*, 220*a* in both the speed and the depth buttons 218, 220 to flash in state 685 to signify to the musician 100 that the control system 104 is in the tremolo program mode. As discussed above, in the program mode the LEDs are preferably programmed to flash at a rate which also indicative of the preset position of the buttons 218, 220.

The controller 300 then determines in decision state 686 which component of the tremolo characteristic, i.e., speed or depth, that the musician is intending to program. In the preferred embodiment, the controller 300 is initially set to program the frequency or speed component, however, if the musician 100 depresses the volume button 216 (FIG. 4), the controller 300 will toggle to the depth or amplitude component. Repeatedly depressing the volume button will cause the controller 300 to toggle between these two components.

Assuming that the controller 300 has determined in decision state 686 that the musician 100 wishes to program the frequency component, the controller 300 then determines in decision state 692 whether the musician 100 has manipulated the program mode select button 212 (FIG. 4) to begin programming the selected frequency preset. The controller 300 continues to flash the frequency LED at a rate corresponding to the preset until the controller 300 receives an input from the program mode select button 212 indicating that the musician 100 has manipulated the button.

The controller 300 then induces the program LED 214 to flicker in state 694 which provides an indication to the musician 100 to begin programming the frequency component for the selected preset. The musician 100 does this by playing the musical instrument 102 to produce an audio signal and then exerting pressure on the tactile member 106 to cause the frequency of the tremolo effect induced on the audio signal to change. Hence, the controller 300 in state 696 reads the pressure input from the sensor 320 (FIG. 5) and adjusts the tremolo frequency component in state 700 accordingly. The controller 300 continues to adjust the frequency component in accordance with the amount of pressure the musician is exerting on the tactile member 106 until the musician 100 manipulates the program button 212 (FIG. 4). This again induces the controller 300 to record in state 704 the frequency value in the memory 330 and the controller 300 then changes the program LED 214 back to solid in state 706.

Hence, the musician programs a frequency component for a selected preset position of the button 218 by entering the program mode, playing the instrument 102, depressing the tactile member 106 to change the frequency and then depressing the program button 212 to record the new desired frequency component for this preset. In the preferred embodiment, there are three separate presets that the musician 100 can program in the previously described manner.

Once the programming of the selected frequency preset has been completed, the controller 300 then determines whether the tremolo programming function 612 has ended. In the preferred embodiment, the tremolo programming function 612 ends when the musician 100 manipulates the program button 212 (FIG. 4) into the operation mode or turns off the control system 104. Otherwise, the controller 300 remains in the program tremolo function 612, returning to state 682, allowing the musician to continue programming frequency and amplitude components for each of the three possible presets for each component.

If the controller 300 determines in decision state 636 that the musician has selected to program one of the amplitude i.e., depth, presets using the tremolo depth button 220, the controller 300 then determines in decision state 720 whether the musician has manipulated the program button 212 to begin programming a particular preset amplitude component for a tremolo characteristic. Once the musician manipulates the program button 212, the controller then sends a signal in state 722 to cause the program LED 214 to flicker which indicates to the musician that the selected amplitude preset component is ready to be programmed.

The musician then begins to play the musical instrument 102 and an audio signal is then sent to the signal modifier 336. This signal is modified by a tremolo characteristic wherein the frequency component and amplitude components correspond to the previously recorded components corresponding to the present positions of the speed and depth buttons 218, 220. The musician can then modify the preset amplitude component by exerting pressure on the tactile member 106. The controller 300 in state 724 receives a signal from the sensor 320 indicative of the increase in pressure and correspondingly adjusts the amplitude component of the tremolo characteristic being applied to the audio signal.

The musician 100 continues playing the musical instrument 102 and exerting pressure on the tactile member 106 until the desired amplitude component for the tactile member 106 is achieved. At that point the musician depresses the program button 212, which is detected by the controller 300 in decision state 730, and the controller 300 then records in state 732 the present amplitude component in the memory 330. The controller 300 then returns the program LED 214 to emitting a solid light and proceeds to decision state 710 in the previously described fashion.

Hence, in the program tremolo function 612, the controller 300 allows the musician 100 to reprogram one or more preset amplitude, i.e., volume, components by entering the program mode, selecting the desired amplitude preset to be reprogrammed, playing the instrument, exerting pressure on the tactile member 106 to achieve the desired amplitude and then pressing the program button 214 to record the desired amplitude in memory.

In the preferred embodiment the program tremolo function 612 enables the musician to program up to three separate preset amplitude and frequency values for a tremolo characteristic that is to be applied to the audio signal produced by the musical instrument 102. The system 104 enables the musician to do this programming while playing the musical instrument 104 and dynamically changing the components until the desired values are obtained. The musician can subsequently select a tremolo characteristic to be applied to the audio signal that is comprised of any combination of the plurality of preset frequency components of the plurality of preset amplitude components.

The foregoing description has described a control system that a musician can program to effectuate changes to an audio signal produced by a musical instrument. The control system enables the musician to program preset characteristics that can later be selected while playing the musical instrument and the control system also allows the musician to dynamically change certain characteristics of the audio signal produced by the musical instrument while playing the musical instrument. While the preferred embodiment has disclosed an electric guitar as the musical instrument it will be appreciated that any musical instrument producing an audio signal that can be modified in the above-described manner can also used in conjunction with the control system without departing from the scope of the present invention. Further, while the preferred embodiment has disclosed the characteristics of volume and tremolo as the characteristics that are applied to change the audio signal, any other characteristics of sound signal can also be changed using the control system without departing from the scope of the present invention.

Although the foregoing description of the preferred embodiments of the present invention has shown, described and pointed out the fundamental novel features of the invention, it will be understood that various omissions, substitutions and changes in the form of the detail of the apparatus as illustrated, as well as the uses thereof, may be made by those skilled in the art, without departing from the spirit of the present invention. Consequently, the scope of the invention should not be limited to the foregoing discussion, but should be defined by the appended claims.

What is claimed is:

1. A control system to be used to change one or more characteristics of an audio signal produced by a musical instrument comprising:

a plurality of user inputs including a tactile member which produces a first signal which is proportionate to the pressure exerted on said tactile member by a musician while said musician is playing said instrument;

a controller which receives said first signal, said controller having a program mode, wherein preset component values for audio characteristics can be programmed by said musician, and an operation mode wherein audio characteristics for an audio signal produced by said musical instrument can be modified by said musician manipulating said plurality of user inputs; and an audio signal modifier, responsive to signals from said controller which modifies said audio signal produced by said musical instrument in response to signals received from said controller.

2. The control system of claim 1, further comprising a transducer and wherein said tactile member comprises an air filled tube mounted on a surface of said musical instrument wherein depression of said air filled tube towards said surface of said musical instrument results in a proportionate change in pressure within said air filled tube and wherein said transducer produces said first signal in response to detecting said proportionate change in pressure.

3. The control system of claim 2, wherein said tactile member is positioned on the musical instrument in a location where said musician does not have to remove his or her hands to manipulate said tactile member.

4. The control system of claim 3, wherein said air filled tube has a square base with a rounded upper hemisphere, wherein said square base is mounted on said surface of said musical instrument.

5. The control system of claim 4, wherein said musical instrument comprises an electric guitar and said tactile member is mounted on said neck of said electric guitar.

6. The control system of claim 1, wherein said controller, when in said program mode, can be programmed by said musician to set an initial starting volume for a volume audio characteristic of said audio signal produced by said musical instrument.

7. The control system of claim 6, wherein said controller, when in said operation mode, produces an audio signal having a volume audio characteristic which is at least said initial starting volume and wherein said controller increases said volume audio characteristic from said initial starting volume in proportion to said first signal generated by said musician exerting pressure on said tactile member.

8. The control system of claim 7, wherein said controller, when in said operation mode, sustains the volume audio characteristic of said audio signal produced by said musical instrument at a first level, which is proportionate to the greatest amount of pressure exerted on said tactile member by said musician, until said musician exerts a greater amount of pressure on said tactile member.

9. The control system of claim 1, wherein said controller, when in said program mode, can be programmed by said musician to set a plurality of initial starting frequencies and a plurality of initial starting amplitudes of a tremolo audio characteristic of said audio signal produced by said musical instrument.

10. The control system of claim 9, wherein said controller, when in said operation mode, produces an audio signal having a tremolo audio characteristic having one of said plurality of initial starting frequencies and having one of said plurality of initial starting amplitudes.

11. The control system of claim 10, wherein said controller, when in said operation mode, increases the frequency of said tremolo audio characteristic in response to said musician exerting pressure on said tactile member.

12. The control system of claim 11, wherein said controller is configured, in said operation mode, so that said musician can switch between said plurality of starting frequencies and said plurality of starting amplitudes of said tremolo audio characteristic by manipulating said plurality of user inputs.

* * * * *